US011189949B2

(12) United States Patent
Wrighton

(10) Patent No.: US 11,189,949 B2
(45) Date of Patent: Nov. 30, 2021

(54) ELECTRICAL CONNECTION DEVICES FOR HIGH POWER APPLICATIONS

(71) Applicant: Rolls-Royce Corporation, Indianapolis, IN (US)

(72) Inventor: Steve Wrighton, Indianapolis, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 0 days.

(21) Appl. No.: 16/825,036

(22) Filed: Mar. 20, 2020

(65) Prior Publication Data

US 2021/0111505 A1 Apr. 15, 2021

Related U.S. Application Data

(60) Provisional application No. 62/913,610, filed on Oct. 10, 2019.

(51) Int. Cl.

| | |
|---|---|
| ***H01R 13/193*** | (2006.01) |
| ***H01R 13/52*** | (2006.01) |
| ***H01R 43/26*** | (2006.01) |
| ***H01R 25/16*** | (2006.01) |
| ***H01R 13/53*** | (2006.01) |
| ***H01R 13/44*** | (2006.01) |

(52) U.S. Cl.

CPC ..... *H01R 13/193* (2013.01); *H01R 13/44* (2013.01); *H01R 13/5219* (2013.01); *H01R 13/53* (2013.01); *H01R 25/162* (2013.01); *H01R 43/26* (2013.01)

(58) Field of Classification Search

CPC ..... H01R 13/193; H01R 23/684; H01R 13/5219; H01R 13/53; H01R 13/44; H01R 43/26; H01R 25/162

USPC ..... 439/259–261, 263

See application file for complete search history.

(56) References Cited

U.S. PATENT DOCUMENTS

| | | | | |
|---|---|---|---|---|
| 2,847,595 A | | 8/1958 | Kaseman | |
| 3,848,088 A | | 11/1974 | Bentz | |
| 4,355,856 A | * | 10/1982 | Porter | H01R 12/87 439/437 |

(Continued)

OTHER PUBLICATIONS

TI Designs: TIDA-01445, Automotive High-Voltage Interlock Reference Design, Retrieved from http://www.ti.com/lit/ug/tidud43a/tidud43a.pdf, TIDUD43A—Sep. 2017—Revised Apr. 2018, 38 pgs.

*Primary Examiner* — Gary F Paumen

(74) *Attorney, Agent, or Firm* — Shumaker & Sieffert, P.A.

(57) ABSTRACT

The disclosure describes a high-power electrical connector providing blind-mating and an environmental sealing connector with a bus bar interfaces that features positional alignment and low friction mating. The electrical connector includes a receptacle with a bus bar electrically isolated from nearby connectors. The connector further includes a plug configured to mate with the receptacle. The plug includes several electrical contacts configured to make an electrical connection to the bus bar of the receptacle, when mated. Within the plug, tensioning device for each electrical contact applies a spring force to the contact. The electrical contacts are sized and positioned to match the bus bar geometry for balanced current flow and to avoid interface internal heating. The electrical connector of this disclosure may be desirable for application in which power electronics interface with other electronics.

20 Claims, 6 Drawing Sheets

(56) References Cited

U.S. PATENT DOCUMENTS

| | | | | | |
|---|---|---|---|---|---|
| 4,373,764 | A * | 2/1983 | Ulrich | H01R 12/85 29/854 |
| 4,530,553 | A * | 7/1985 | Aujla | H01R 12/82 439/260 |
| 4,592,608 | A * | 6/1986 | Ohtsuka | H01R 13/631 361/737 |
| 4,647,130 | A | 3/1987 | Blair et al. | |
| 5,022,874 | A | 6/1991 | Lostumo | |
| 5,098,318 | A * | 3/1992 | Suter | H02B 11/04 200/255 |
| 6,019,625 | A * | 2/2000 | Nimura | H01R 13/62905 439/259 |
| 6,139,347 | A * | 10/2000 | Nebon | H02B 11/04 439/251 |
| 6,313,635 | B1 | 11/2001 | Noll | |
| 6,824,410 | B1 * | 11/2004 | Co | H01R 12/88 324/750.25 |
| 8,845,350 | B2 * | 9/2014 | Connell | H01H 50/54 439/268 |
| 9,543,693 | B2 | 1/2017 | Koszeghy et al. | |
| 9,622,373 | B1 | 4/2017 | Sarti | |
| 2009/0073624 | A1 | 3/2009 | Scholer et al. | |

* cited by examiner

ELECTRICAL CONNECTION DEVICES FOR HIGH POWER APPLICATIONS

This application claims the benefit of U.S. Provisional Application No. 62/913,610 filed Oct. 10, 2019, which is incorporated herein by reference in its entirety.

TECHNICAL FIELD

The disclosure relates high voltage electrical connectors.

BACKGROUND

High voltage connection interfaces may be implemented using lugs or other open air terminations. These open terminations are vulnerable as a hazard to personnel and may be exposed to a variety of environmental impingements such as debris and moisture. To avoid exposure to the hazards associated with open termination and the various environment impingement, electrical connector devices referred to as blind-mating electrical connection devices may provide a housing or other encasement surrounding the electrical connectors (hence the term "blind-mating" as the coupling—or in other words, mounting—of the electrical connectors to reciprocal connectors in a receptacle is hidden by the housing) to potentially prevent or at least reduce contact with the electrical connectors and potentially avoid or at least reduce environmental impingement. However, the blind-mating electrical connection devices may have limited feasibility for high power applications.

SUMMARY

In general, the disclosure describes an example high-power electrical connection device that provides blind mating and an environmentally sealed connector with bus bar interfaces that features positional alignment and low friction mating. The electrical connection device of this disclosure (also referred to as an electrical connector or simply connector) includes a receptacle with a bus bar electrically isolated from nearby connectors. The electrical connector further includes a plug configured to mate with the receptacle. The plug may include one or more electrical contacts configured to make an electrical connection to the bus bar of the receptacle, when mated. Within the plug, a tensioning device for each electrical contact applies a spring force to the contact. The electrical contacts may be sized and positioned to match the bus bar geometry to facilitate balanced current flow and potentially avoid or at least reduce interface internal heating. Power electronics (and possibly high power electronics) may employ the electrical connector of this disclosure to interface with other electronics (and again, possibly high power electronics). Some example applications may include rack mounting power electronics along with other electronics, such as electronics in an aircraft or other vehicles.

In one example, the disclosure is directed to a device electrical connection device, the device comprising: a plug cavity defined by a base and by one or more walls extending away from the base at approximately right angles to the base, wherein the one or more walls form an opening on the opposite side of the plug cavity from the base; a bus bar, wherein the bus bar extends through the base and into the plug cavity, a first electrical contact and a second electrical contact. The first electrical contact and the second electrical contact are arranged within the plug cavity, the first electrical contact is arranged to make a mechanical and electrical connection to a first surface of the bus bar, and the second electrical contact is arranged to make a mechanical and electrical connection to a second surface of the bus bar, wherein the second surface is opposite the first surface. The device also includes a tensioning device, arranged: within the plug cavity; with a long axis of the tensioning device parallel to a long axis of the first electrical contact and the second electrical contact; such that the tensioning device applies a force to the first electrical contact perpendicular to the first surface of the bus bar, wherein the force presses the first electrical contact toward the bus bar.

In another example, the disclosure is directed to an electrical connection system, the system comprising: a receptacle including: a shell cowling, wherein the shell cowling comprises a rear surface and one or more walls extending away from the rear surface at approximately right angles to the rear surface, wherein the one or more walls form a shell cavity with a shell cavity opening on the opposite side of the shell cavity from the rear surface, a first bus bar, wherein the first bus bar extends through the rear surface and into the shell cavity. The electrical connection system also includes a plug including: a plug cavity defined by a base and by one or more walls extending away from the base at approximately right angles to the base, wherein the one or more walls form a plug cavity opening on the opposite side of the plug cavity from the base; a second bus bar, wherein the second bus bar extends through the base and into the plug cavity, a first electrical contact and a second electrical contact, wherein the first electrical contact and the second electrical contact are arranged within the plug cavity. The first electrical contact is arranged to make a mechanical and electrical connection to a first surface of the second bus bar, and the second electrical contact is arranged to make a mechanical and electrical connection to a second surface of the second bus bar, wherein the second surface is opposite the first surface. The receptacle is configured to mate with the plug and when the receptacle and the plug are in a mated position, the electrical contacts are arranged to form an electrical connection between the first bus bar and the second bus bar.

In another example, the disclosure is directed to a method comprising: forcing, by a first spring of a plug, a first tensioning device in a first direction; forcing, by a second spring of the plug, a second tensioning device in a second direction. The first direction is a reciprocal of the second direction. Also, sliding the first tensioning device along a first friction pad, wherein the first tensioning device is positioned within a plug cavity of the plug and the first friction pad is positioned within a shell cavity of the receptacle, and sliding the second tensioning device along a second friction pad, wherein the second tensioning device is positioned within the plug cavity of the plug and the second friction pad is positioned within the shell cavity of the receptacle. In response to sliding the first tensioning device along the first friction pad, applying by the first friction pad, a first force to the first tensioning device, wherein the first force is in the second direction, and applying, by the first spring, the first force to a first electrical contact. In response to applying the first force to the first electrical contact, sliding the first electrical contact along a first bus bar, wherein the first electrical contact is positioned within the plug cavity and the first bus bar is positioned within the shell cavity. In response to sliding the first electrical contact along the first bus bar, establishing, by the first electrical contact, an electrical connection between the first bus bar and a second bus bar, wherein the second bus bar is positioned within the plug cavity.

The details of one or more examples of the disclosure are set forth in the accompanying drawings and the description below. Other features, objects, and advantages of the disclosure will be apparent from the description and drawings, and from the claims.

DETAILED DESCRIPTION

Various aspect of the techniques described in this disclosure are directed to a high power electrical connector configured for blind-mating and providing an environmental sealing connector with a bus bar interfaces that features positional alignment and low friction mating. In some examples, the connector may include multiple isolated bus bar interfaces such as for a three-phase power connection. The electrical connector includes a receptacle with a bus bar electrically isolated from any nearby connectors. The connector further includes a plug configured to mate with the receptacle. Each plug may include several electrical contacts configured to make an electrical connection to the bus bar in the receptacle, when mated. A tensioning device for each electrical contact may apply a spring force to the contact. The tensioning device may include a compression bar. When not mated (or, in other words, when in a free state), the tensioning device springs may force the hinged compression bar to angle upward, placing the electrical contacts in position for mating with the bus bar.

The receptacle may include friction pads, which may compress the tensioning device onto the contacts when mated. When the plug is mated to the receptacle and fully seated, the friction pads cause the compression bars to lower and apply a force to the electrical contacts via the springs. The shell cowling of the receptacle may be configured to compress against an environmental gasket at the base of the plug cavity to prevent the ingress of debris, fluids, etc., that might impact the electrical conduction or create a shorting path. During mating of the plug to the receptacle, the compression of the electrical contacts of the plug to the incoming bus bar of the receptacle may be accomplished at approximately a half-way point along the contacts and the bus bar. For the second half of the mating, the electrical contact slides along the surface of the bus bar, under compression, thereby potentially removing build-up on the bus bar, such as corrosion or contact debris. In this manner the electrical contacts connect the bus bar in the plug to the bus bar in the receptacle. The electrical contacts are sized and positioned to match the bus bar geometry for balanced current flow and to avoid interface internal heating.

Figure 1:
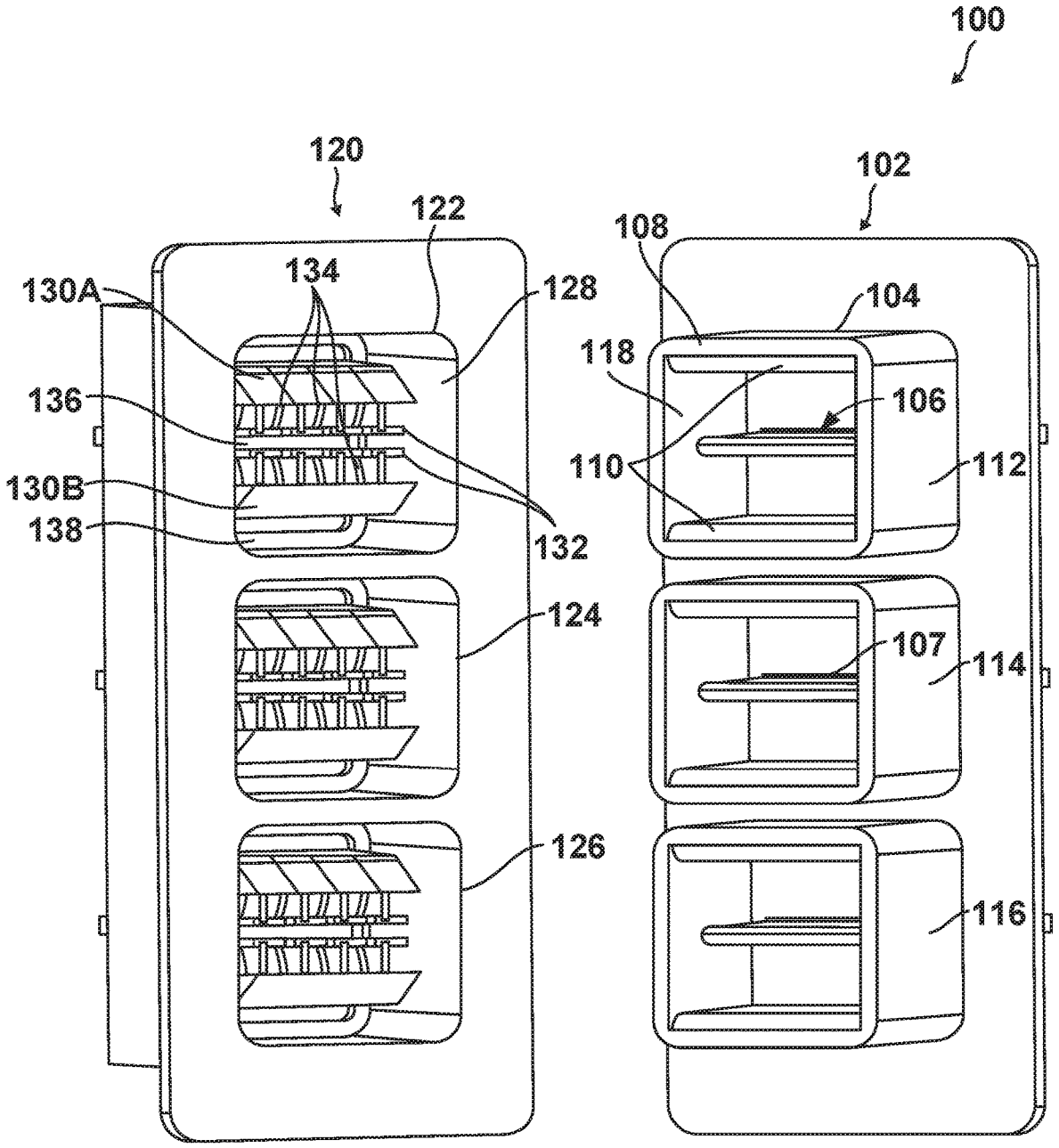
FIG. 1 is a conceptual diagram illustrating the high voltage connector system, which includes a plug and a receptacle, according to one or more techniques of this disclosure.

FIG. 1 is a conceptual diagram illustrating the high voltage connector system, which includes a plug and a receptacle, according to one or more aspects of the techniques of this disclosure. The example of high voltage connector system 100 shown in the example of FIG. 1 includes three plug and receptacle pairs. In other examples, the high voltage connector system 100 may include more or fewer plug and receptacle pairs.

Receptacle assembly 102 includes three receptacles 112, 114 and 116. Each of receptacle 112-116 includes a shell cowling 104, a bus bar 106, a sealing face 108, and friction pads 110, which are only referenced for receptable 114 in the example of FIG. 1 to simplify the description and ease illustration. Receptacle assembly 102 may be made from a variety of non-conductive structural materials such as molded or machined plastics, or any other type of non-conductive structural materials.

Shell cowling 104 is shown as a rectangular shape with rounded corners in the example of FIG. 1. In other examples, shell cowling 104 may be implemented with other shapes, e.g., circular, elliptical, triangular, square, etc. In addition, receptacle 116 may include, as part of shell cowling 104 or other component, a bulge, notch or other key shape to ensure that receptacle assembly 102 and only be matched to (and thereby inserted into) plug assembly 120 in one direction (not shown in FIG. 1). In other examples, one or more of the plug-receptacle pairs may be shaped as an octagon, pentagon or other shape to ensure the electrical connector is mated in a particular orientation.

The rounded rectangular shape may provide advantages over other shapes where one such advantage may be to simplify the self-alignment during blind mating of plug assembly 120 to receptacle assembly 102. Examples of a blind mating configuration may be found, for example, when plug assembly 120 to receptacle assembly 102 are used in a box-to-box configuration, in a rack mounted application, or similar application. Also, in the example of a molded component, rounded corners may relieve stresses caused by the molding process that may cause weakness or cracking for sharp-edged corners.

The walls of shell cowling 104 may be configured to form an approximately uniform dimension extending from the opening defined by sealing face 108 to the rear surface of the receptacle for both the inner diameter and outside diameter of shell cowling 104. The inner diameter of the shell cowling walls form shell cavity 118, similar to plug cavity 128. Similarly, the walls that define plug cavity 128 may form an approximately uniform dimension from the opening to the back wall or base of the plug cavity. The proximately uniform dimension may allow the walls of receptacles of receptacle assembly 102 to slide along the walls during mating with the plugs of plug assembly 120 until fully seated. In the example of a circular shaped plug and receptacle, the walls may be considered a single wall with an approximately uniform diameter.

Bus bar 106, as shown in the example of FIG. 1, is arranged to extend horizontally across the inside dimension of shell cowling 104 at approximately the midpoint in the vertical dimension of shell cowling 104. In the foregoing described example arrangement, the creepage distance from bus bar 106 to bus bar 107 of the adjacent receptacle 114 includes the interior surface of lower friction pad 110, along the surface of sealing face 108, and along the outer surface of shell cowling 104 before reaching the outer surface of receptacle 114. The length of the creepage distance and the tortuous path required for an arc to travel between adjacent bus bars may provide arc protection for system 100. Bus bar 106 may extend through an opening in the rear surface of receptacle assembly 102 to connect, for example, to a power source or a load. The opening in the rear surface of receptacle 112 may be configured such that bus bar 106 may be installed with an interference fit to minimize any gaps between bus bar 106 and the material of receptacle assembly 102. In addition, bus bar 106 may be bonded in place with non-conductive sealing bond to further prevent gaps between the interior of shell cowling 104 and the rear surface of receptacle assembly 102. In other examples, bus bar 106 may be attached to receptacle assembly 102 using vibratory, heat or other techniques.

Friction pads 110 are attached to the upper inner surface and lower inner surface of shell cowling 104, and approximately parallel to bus bar 106. Friction pads 110 may be bonded to shell cowling 104 using a variety of different processes, including one or more of the processes discussed above with respect to attaching the bus bar 106. The edges of friction pads 110 adjacent and parallel to cowling face 108 may be beveled, rounded or a similar shape to accept the mating of the compression bar of tensioning devices 130A and 130B (collectively tensioning devices 130). Friction pads 110 may comprise a low friction rigid or semi-rigid material, such as PTFE, ceramic, or similar material. In some examples, friction pads 110 may comprise one or more layers, with the mating surface layer that comes in contact tensioning devices 130 comprising a low friction material.

Plug assembly 120 includes plugs 122, 124 and 126. To simplify the explanation and the figure, the components of plugs 122, 124 and 126 may only be referenced once for plug assembly 120, rather than for each of plugs 122, 124 and 126. However, plugs 124 and 126 may include similar components as those discussed below with respect to plug 122.

The components of plug assembly 120 include plug cavity 128, which surrounds bus bar 136, electrical contacts 132, environmental gasket 138, and tensioning devices 130. Tensioning devices 130 comprise springs 134, compression bars and hinges (not shown in FIG. 1).

Electrical contacts 132 (which may also be referred to as "contacts 132"), are electrically and mechanically coupled to bus bar 136. When plug assembly 120 is mated and fully seated within receptacle assembly 102, contacts 132 electrically connect bus bar 136 to bus bar 106.

Tensioning device 130A is arranged above each upper contact 132 and tensioning device 130B is below each lower contact 132. In a free state (or, in other words, an uncoupled or unmated position), springs 134 force the hinged compression bar of tensioning device 130A to angle upward and tensioning device 130B to angle downward, placing the electrical contacts in position for mating with bus bar 106. In other words, the springs are configured to push the tensioning devices apart and away from bus bar 136, which may release some compression force on electrical contacts 132, thereby placing electrical contacts 132 in a position to slide onto bus bar 106. The angle or direction of upper tensioning device 130A is reciprocal to the angle or direction of lower tensioning device 130B.

As plug 122 and receptacle 112 move toward the mated position (or, in other words, in a coupled position), tensioning devices 130 slide along friction pads 110, which press downwards on the upper tensioning devices 130 and upward on the lower tensioning devices 130. Springs 134 extend from the compression bar of each tensioning device 130 and are arranged to apply a force to each electrical contact when plug assembly 120 and receptacle assembly 12 are mated.

In the example of FIG. 1, each of plugs 122, 124, and 126 has four electrical contacts 132 arranged along and parallel to the upper portion of each plug cavity, e.g. plug cavity 128. Similarly, each plug includes four electrical contacts 132 arranged along and parallel to the lower portion of each plug cavity. The multiple electrical contacts 132 are configured to accommodate nominal misalignment of bus bars 106 and 136 as a result tolerance stack-ups in the bus bars, the connector shell cowling and plug cavity guidance geometries, and in the tensioning devices 130. In other examples, plugs 122, 124 and 126 may be scalable to include more than four or less than four sets of electrical contacts 132 and tensioning devices 130. For example, to accommodate higher power, plug assembly 120 may include plugs with six, eight or more sets of electrical contacts 132 and tensioning devices 130 arranged along a longer bus bar 136. The dimensions of the bus bar (e.g., how thick and how wide) as well as the selected material for the bus bar and electrical contacts may depend on the magnitude of current the electrical connector is expected to handle.

Environmental gasket 138 may be arranged at the base of each plug cavity. Environmental gasket 138 (also referred to as "gasket 138"), may be composed of a semi-rigid or flexible material. As shown in the example of FIG. 1, the surface of sealing face 108 of shell cowling 104 is arranged to compress gasket 138, when in the mated position. In this manner, gasket 138 may prevent or at least reduce the ingress of debris or fluids that may cause corrosion that may otherwise impact the electrical connection and possibly provide a conductive path for potential arcing between bus bars 106.

The electrical connector of this disclosure may be desirable for application in which power electronics interface with other electronics. Some examples applications may include rack mounting power electronics along with other electronics, such as in an aircraft or other vehicles. The electrical connector of this disclosure may have advantages over other types of connectors in a "box-to box" configuration. In a box-to-box configuration, the retention and positional stability of the housing for the electronics connected to the electrical connector are a function of mounting of the housing and other components in separate components cases. Also, depending on the application, additional features may be added to satisfy a number of peripheral requirements such as grounding fingers, guides and daggers, contacts for high voltage interlock loop (HVIL) safety, and other features.

In some examples, HVIL is centralized interlock system with a common interlock loop shared with some or all high-voltage components of a system, such as a vehicle system. An individual or internal interlock mechanism may help ensure the assembly of each subsystem. In the example of a vehicle, a crash signal may be interfaced to the interlock loop to turn off the high-voltage network to during and after a collision, or high stress, such as heavy weather or high g-force maneuvering. Some examples of HVIL may include diagnosis for functioning of interlock system to detect and differentiate possible failure modes.

Other advantages of the techniques of this disclosure may include a combination of features not found on available industry connectors such as blind mating, low friction intermateability, scalable, environmentally sealed, self-cleaning contacts, and tolerant of nominal mis-alignment and tolerance stacks. By sliding electrical contacts 132 along bus bar 106 during mating, the electrical contacts 132 may remove debris or corrosion on bus bar 106, thereby making for better electrical interface surfaces, when compared to other types of contacts that do not mate with a self-cleaning action. A better electrical interface may reduce impedance between the bus bar and the electrical contact, which may result in improved current flow and reduced internal heating when compared to other types of electrical contacts.

Blind mating may be desirable for example in a rack mounted equipment, so that a piece of equipment may be slid into a rack and blind mate to high voltage, low voltage and communication signal connections. One example may include power thermal management systems (PTMS). The International Electrotechnical Commission's (IEC) definitions for voltage are shown in table 1 below:

TABLE 1

IEC Voltage Definitions

| IEC voltage range | AC | DC | Risk |
|---|---|---|---|
| High Voltage | >1000 Vrms | >1500 V | Arcing |
| Low Voltage | 50-1000 Vrms | 120-1000 V | Electric shock |
| Extra-Low Voltage | 50 Vrms | <120 V | Low |

Figure 2:
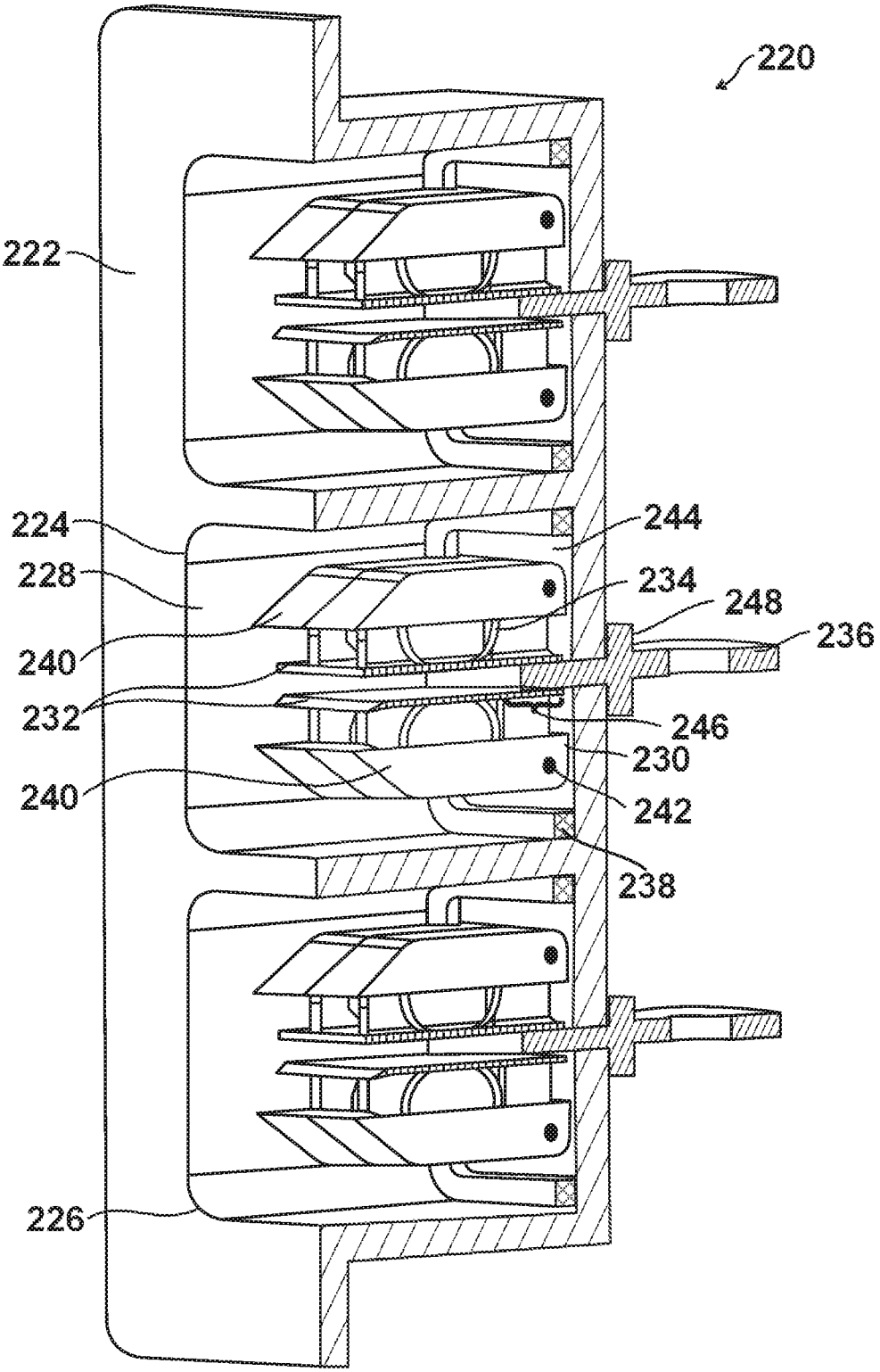
FIG. 2 is a cross-sectional isometric diagram illustrating additional details of a plug assembly according to one or more techniques of this disclosure.

FIG. 2 is a cross-sectional isometric diagram illustrating additional details of a plug assembly according to one or more techniques of this disclosure. Plug assembly 220 is an example of plug assembly 120 described above in relation to FIG. 1. The components of plug assembly 220 have the same function and characteristics as described above for plug assembly 120.

Plug assembly 220 includes plugs 222, 224 and 226. To simplify the explanation and the figure, only the components of plugs 224 will be described in detail. Plug 224 includes plug cavity 228, bus bar 236, electrical contacts 232, environmental gasket 238, and tensioning devices 230. Tensioning devices 230 comprise springs 234, compression bars 240 and hinges 242.

Electrical contacts 232, are electrically and mechanically coupled to bus bar 236 at the portion 246 the of electrical contacts 232 near hinges 242 and along the back wall 244 of plug cavity 228. In some examples, the portion 246 of the electrical contacts may maintain contact with bus bar 236 by a compression fit caused by the pressure of upper and lower compression bars 240 of tensioning devices 230. In other examples, electrical contacts 232 may be bonded to bus bar 236 with solder, conductive epoxy or some similar conductive bond. Electrical contacts 232 may be fabricated using a variety of conductive materials including copper, conductive alloys and similar materials.

As shown in the example of FIG. 2, electrical contacts 232 may have a partial I-beam or T-shape. The flat portion at the top (or bottom) surface of the T-shape is configured to make mechanical and electrical contact with bus bar 236. Also, when plug assembly 220 is mated and fully seated within the receptacle assembly, such as receptacle assembly 102 described above in relation to FIG. 1, contacts 232 electrically connect bus bar 236 to bus bar 106. Electrical contacts 232 are sized and positioned to match the bus bar geometry for balanced current flow and to avoid internal heating at the interface between the bus bars and electrical contacts 232.

As described above in relation to FIG. 1, tensioning device 230 is arranged above each upper contact and below each lower contact 232. Springs 234 extend from compression bars 240 and make mechanical contact with electrical contacts 232 on the T-shape portion opposite the bus bar. In this manner, springs 234 apply a force from compression bar 240 toward bus bar 236, as well as the receptacle bus bar, when mated. When not mated, springs 234 force the hinged compression bar 240 to angle upward (not shown in FIG. 2), placing the electrical contacts in position for mating with bus bar 106 of receptacle assembly 102 described above in relation to FIG. 1. In some examples, electrical contacts are generally in a fixed position relative to the bus bar and the force relief of the tensioning bar, as a result of of the springs pushing on the contact, during demating of the plug and receptacle, may result in compression bars 240 angling up and down about hinges 242.

In some examples, compression bar 240 may be fabricated from a rigid or semi-rigid, non-conductive material. Also, as described above in relation to FIG. 1, environmental gasket 238 is arranged is arranged at the base, or back wall 244, of each plug cavity 228.

Bus bar 236 extends through an opening in back wall 244, similar to bus bar 106 described above in relation to FIG. 1. In some examples, bus bar 236 may include a stop 248 to provide additional mechanical stability between the housing of plug assembly 220 and bus bar 236. The shape of stop 248 depicted in FIG. 2 is just one possible example of an arrangement for bus bar 236.

Figure 3:
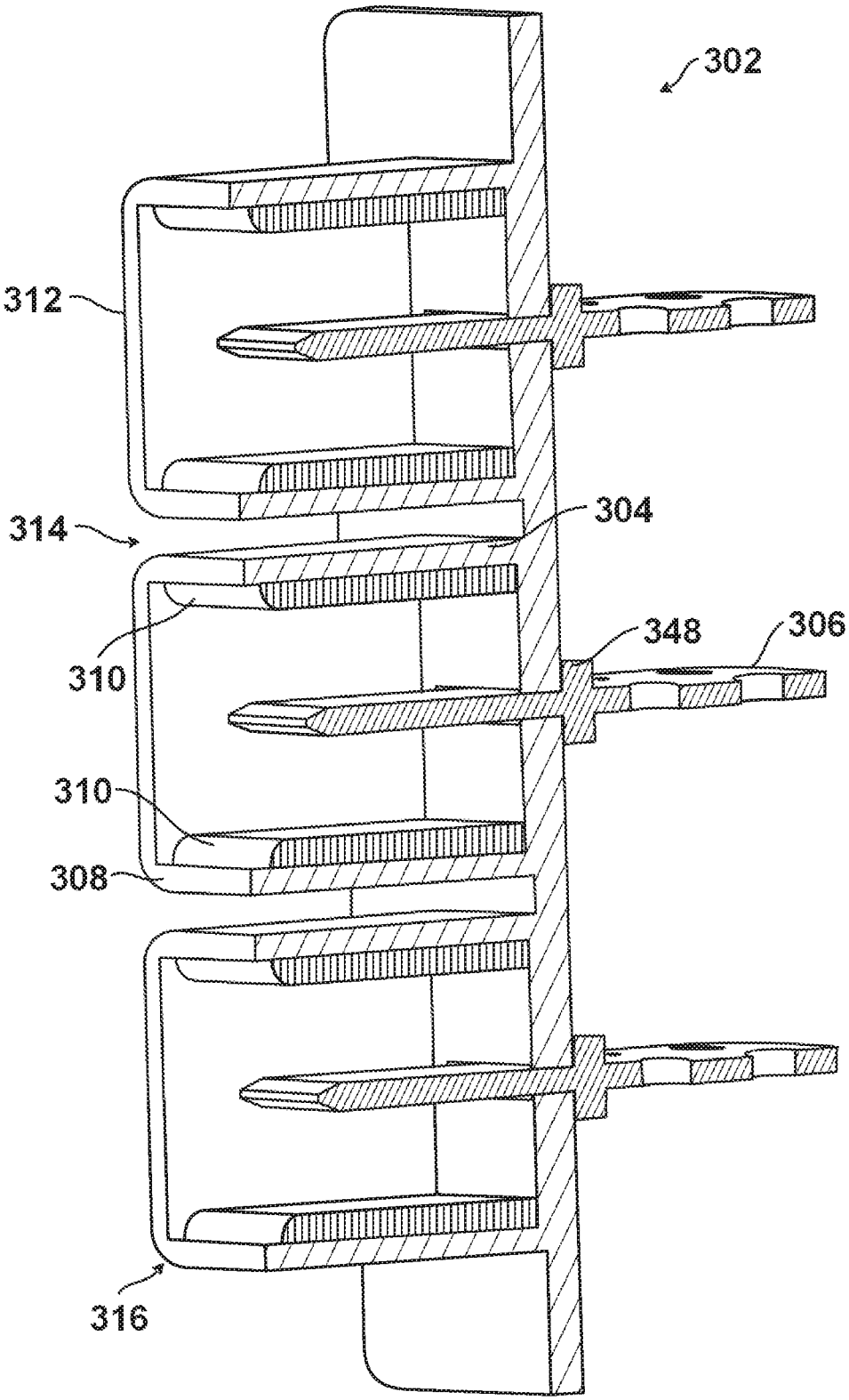
FIG. 3 is a cross-sectional isometric diagram illustrating additional details of a receptacle assembly according to one or more techniques of this disclosure.

FIG. 3 is a cross-sectional isometric diagram illustrating additional details of a receptacle assembly according to one or more techniques of this disclosure. Receptacle assembly 302 is an example of receptacle assembly 102 described above in relation to FIG. 1. The components of plug assembly 320 have the same function and characteristics as described above for plug assembly 102.

Receptacle assembly 302 includes three receptacles 312, 314 and 316. Each receptacle includes a shell cowling 304, bus bar 306, sealing face 308 and friction pads 310. The components of receptacle assembly 302 are only referenced in detail for receptable 314 in the example of FIG. 3 to simplify the description.

Similar to bus bar 236 described above in relation to FIG. 2, bus bar 306 may include a stop 348 to improve mechanical stability when assembled to the shell cowling 304 of receptacle assembly 302. Both bus bars 236 and 306 may include holes or other features to interface with screws or other fasteners in the equipment, rack or other location in which the electrical connector of this disclosure is installed.

In the example of FIG. 3, friction pads 310 are depicted as a monolithic material. In some examples, friction pads may include one or more layers of material. For example, along the interface with shell cowling 304, friction pads 310 may comprise a material with compatible bonding properties for securely fastening to shell cowling 304. Along the opposite surface, which is configured to slidably mate with tensioning devices 130 described above in relation to FIG. 1, friction pads 310 may comprise a low friction material that is compatible with the compression bars of tensioning devices 130.

The example of FIG. 3 also depicts friction pads 310 with rounded edges along the edge of friction pads 310 adjacent to sealing face 308. In other examples, the edges of friction pads 310 may be beveled, or some other shape configured to guide the compression bars of tensioning devices 130 into position during mating.

Figure 4:
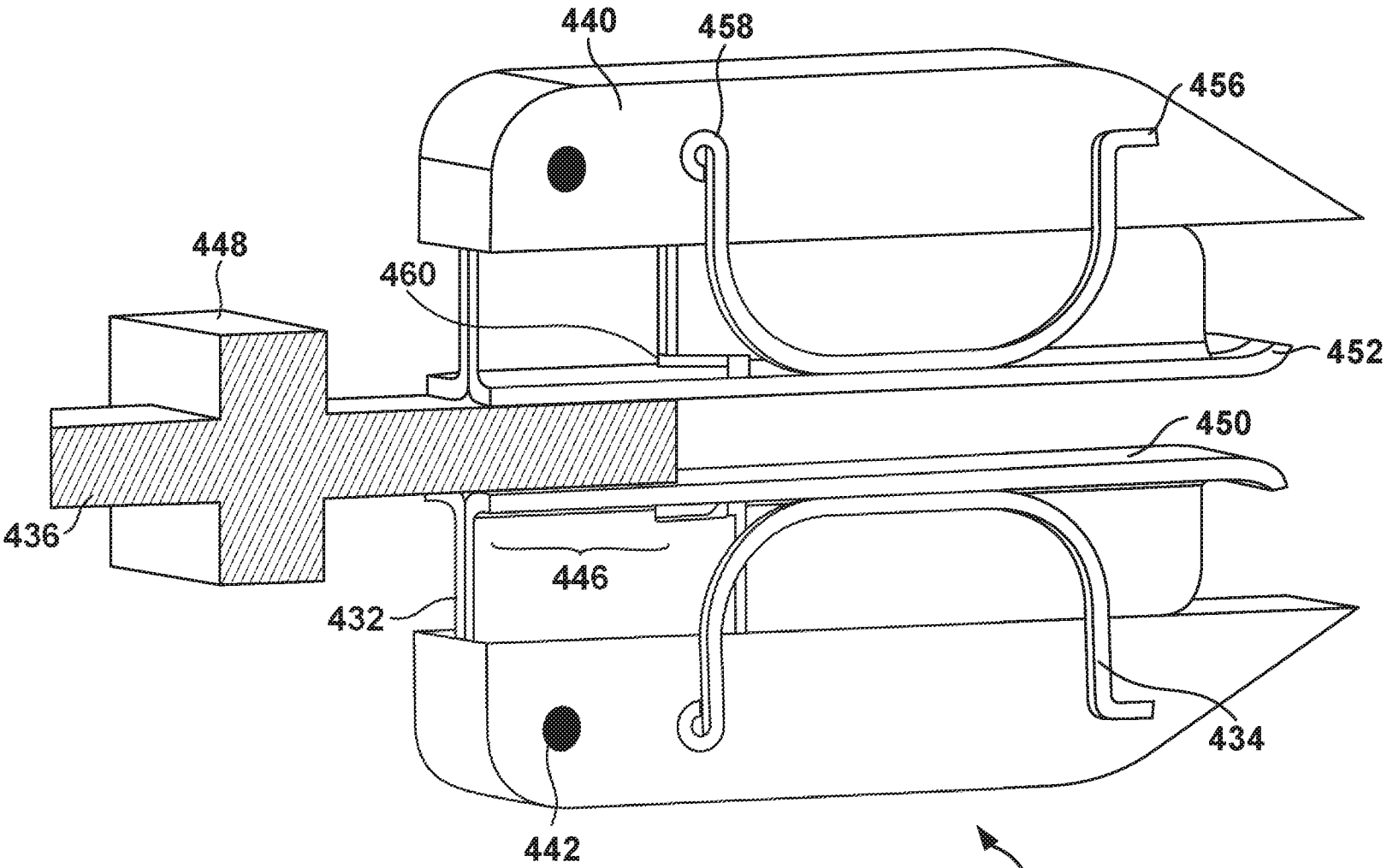
FIG. 4 is a cross-sectional isometric diagram illustrating additional details of an electrical contact and tensioning device assemblies according to one or more techniques of this disclosure.

FIG. 4 is a cross-sectional isometric diagram illustrating additional details of an electrical contact and tensioning device assemblies according to one or more techniques of this disclosure. The portion of the plug assembly in FIG. 4 is an example of plug assemblies 120 and 220 described above in relation to FIGS. 1 and 2. The components of plug assembly 220 have the same function and characteristics as described above for plug assemblies 120 and 220.

FIG. 4 depicts bus bar 436 with stop 448, electrical contacts 432, tensioning devices 430 with springs 434, compression bars 440 and hinges 442. FIG. 4 also depicts the bus bar interface 450, and mating guide 452 and relief 460 of contact 432 as well as spring retention features 456 and 458.

As described above in relation to FIG. 2, electrical contacts 432, electrically and mechanically couple to bus bar 436 at the portion 446. In some examples, the portion 246 of the electrical contacts may maintain contact with bus bar 236 by a compression fit caused by the pressure of upper and lower compression bars 240 of tensioning devices 230.

As shown in the example of FIG. 2, electrical contacts 432 may have a partial I-beam or T-shape to form a bus bar interface 450 configured to make mechanical and electrical contact with bus bar 436 as well as with bus bar 106 depicted in FIG. 1. Electrical contacts 432 may also include a curved, beveled or similar shaped mating guide 452, configured to guide contacts 432 onto bus bar 106 during insertion. In some examples, contacts 432 may be fabricated from two separate L-shaped sub-components and bonded together. In some examples, the (T-shape) of the contacts are bonded together behind and forward of the relief area 460, which may allow the electrical contact to bend, at that point to accommdate small geometric variations (tolerances), rather than being hinged.

Tensioning device 430 is arranged below lower contact 432. Springs 434 extend from compression bars 440 and make mechanical contact with contact 432 on the T-shape portion opposite bus bar interface 450. Springs 434 may include retention features 458 and 456 to retain each spring in place in compression bar 440 on either side of contact 432. In the example of FIG. 4, retention feature 458 is a curled portion of spring 434 assembled to a compatible portion of compression bar 440. Spring 434 may be first assembled to retention feature 458, then snapped into place using the L-shaped retention feature 456. However, retention features 458 and 456 are only one possible example of a technique to retain spring 434 in place. In other examples, spring 434 may have a shape different from that shown in FIG. 4.

Figure 5:
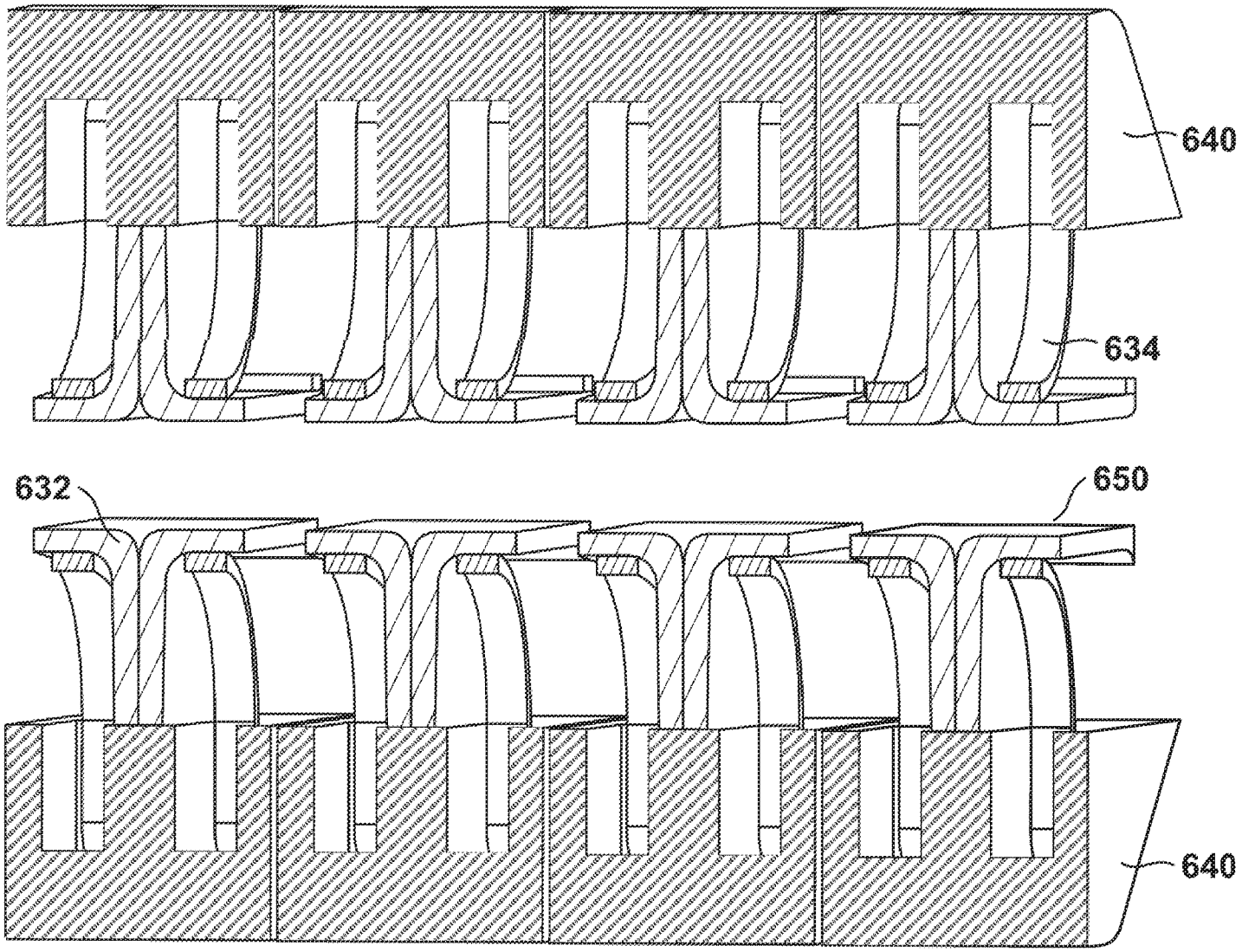
FIG. 5 is a cross-sectional isometric diagram illustrating additional details of the electrical contacts and springs according to one or more techniques of this disclosure.

FIG. 5 is a cross-sectional isometric diagram illustrating additional details of the electrical contacts and springs according to one or more techniques of this disclosure. The portion of the plug assembly in FIG. 5 is an example of plug assemblies 120, 220 described above in relation to FIGS. 1, 2 and 4.

FIG. 5 depicts electrical contacts 632 with bus bar interface 650, springs 634, and compression bars 640. The example of FIG. 5 shows how springs 634 extend from compression bars 640 on either side of contacts 632 and apply a force to contact 632 on the T-shape portion opposite bus bar interface 650.

Figure 6:
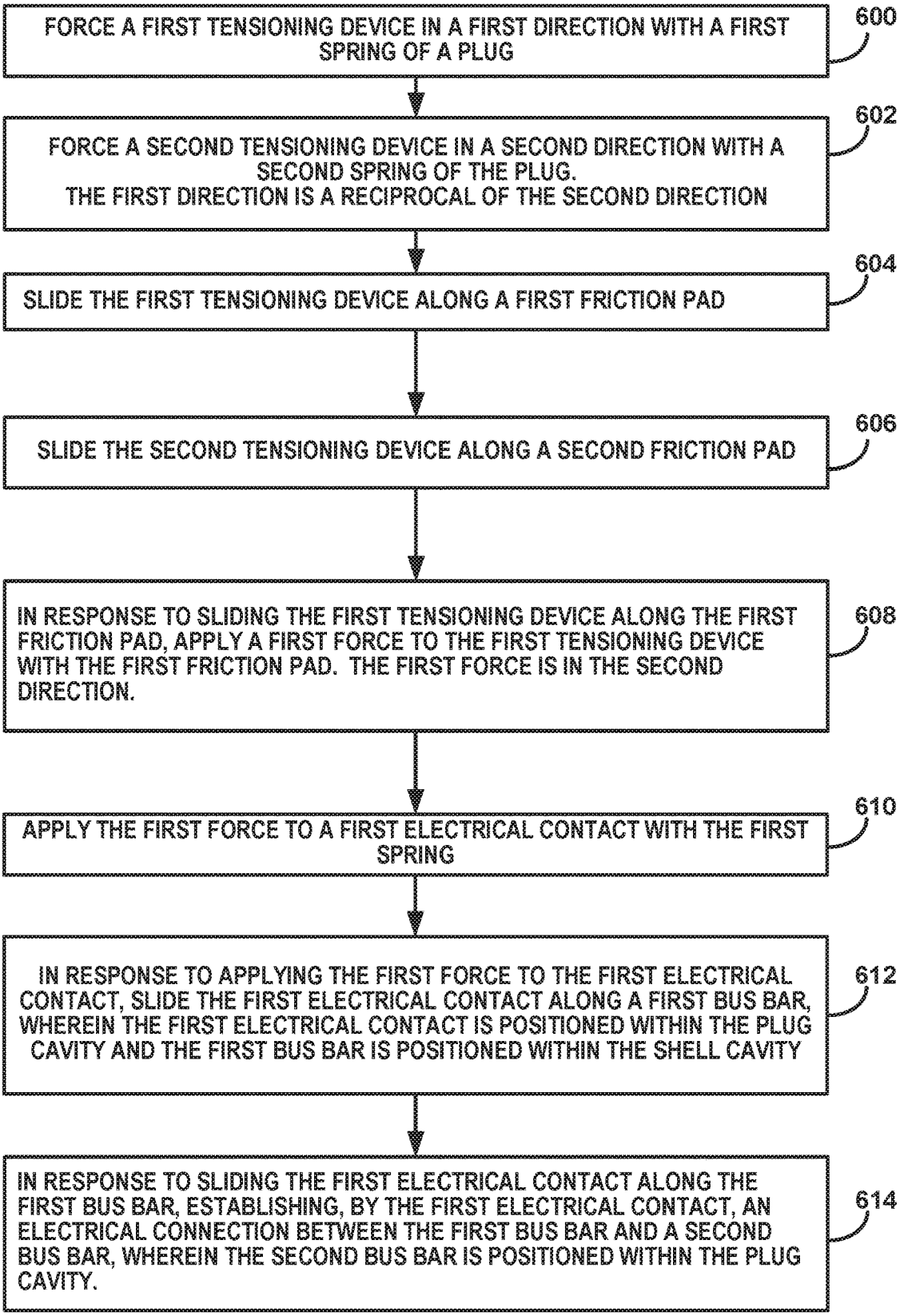
FIG. 6 is a flow chart illustrating an example mode of operation of the electrical connector of this disclosure.

FIG. 6 is a flow chart illustrating an example mode of operation of the electrical connector of this disclosure. The blocks of FIG. 6 will be described in terms of FIGS. 1 and 4, unless otherwise noted.

When in the unmated position, i.e. before the plug of the electrical connector is mated to the receptacle, a first spring of plug 122 may force a first tensioning device, e.g. upper tensioning device 130A upward a first direction and away from busbar 136 (600). Also, a second spring, e.g. spring 434, of the plug on lower tensioning device 130B may force lower tensioning device downward, in a reciprocal (aka opposite) direction, also away from bus bar 136 (602). As described above in relation to FIG. 1, the tensioning devices in this position allow the electrical contacts, e.g. 432, to a position with reduced compressive force to mate with bus bar 106 in receptacle 112. In other words, the electrical contacts are relieved of the contacting force to the bus bar, allowing the opposing bus bar to initially position between the upper and lower electrical contacts without a clamping force.

When mated, the upper and lower tensioning devices e.g. 130A and 130B slide along the respective upper and lower friction pads 110 (604, 606). As described above in relation to FIG. 1, the width of bus bar 106 and the width of friction pads 110 are scalable to accommodate more or fewer tension devices and electrical contacts.

Sliding upper tensioning device 130A along upper friction pad 110, causes friction pad 110 to apply a force to upper tensioning device 130A in a reciprocal direction to the force applied to upper tensioning device 130A by the spring of tensioning device 130A (608). In other words, upper tensioning device 130A is forced in the same direction as lower tensioning device 130B, when unmated.

As depicted above in FIGS. 1 and 4, the long axes of the upper and lower tensioning devices 130A and 130B are parallel to the long axis of the upper and lower electrical contacts 132. Therefore, when mated, the springs of upper tensioning device 130A apply the force from the upper friction pad to an upper electrical contact of the electrical contacts 132 (610). Similarly, the springs of lower tensioning device 130B apply the upward force from the lower friction pad to a lower electrical contact of the electrical contacts 132. The upward force from the lower friction pad and downward force from the upper friction pad press the electrical contacts toward bus bars 106 and 136 (612). Because electrical contacts 132 slid along bus bar 106 during the mating process, the electrical contacts may clean some debris and corrosion that may be present either on the surface of busbar 106 or on the contact surface, e.g. bus bar interface 450, of the electrical contacts. The force on electrical contacts 132 toward bus bars 106 and 136 establish an electrical connection between bus bars 106 and 136 (614).

The techniques of this disclosure may also be described in the following examples.

Example 1. An electrical connection device, the device comprising: a plug cavity defined by a base and by one or more walls extending away from the base at approximately right angles to the base, wherein the one or more walls form an opening on the opposite side of the plug cavity from the base; a bus bar, wherein the bus bar extends through the base and into the plug cavity, a first electrical contact and a second electrical contact. The first electrical contact and the second electrical contact are arranged within the plug cavity, the first electrical contact is arranged to make a mechanical and electrical connection to a first surface of the bus bar, and the second electrical contact is arranged to make a mechanical and electrical connection to a second surface of the bus bar, wherein the second surface is opposite the first surface. The device also includes a tensioning device, arranged: within the plug cavity; with a long axis of the tensioning device parallel to a long axis of the first electrical contact and the second electrical contact; such that the tensioning device applies a force to the first electrical contact perpendicular to the first surface of the bus bar, wherein the force presses the first electrical contact toward the bus bar.

Example 2. The device of example 1, wherein he tensioning device comprises one or more springs configured to apply the force to the first electrical contact.

Example 3. The device of any of examples 1-2 or any combination thereof, wherein the tensioning device is a first tensioning device, the electrical connection device further comprising a second tensioning device arranged: within the plug cavity; with a long axis of the second tensioning device parallel to a long axis of the first electrical contact and the second electrical contact; such that the tensioning device applies a force to the second electrical contact perpendicular to the second surface of the bus bar, wherein the force from the second tensioning device presses the second electrical contact toward the bus bar.

Example 4. The device of any combination of examples 1-3, wherein the one or more walls define an approximately uniform dimension for the plug cavity extending from the base to the opening.

Example 5. The device of any combination of examples 1-4, further comprising a gasket disposed along the base of the plug cavity.

Example 6. A electrical connection system, the system comprising: a receptacle including: a shell cowling, wherein the shell cowling comprises a rear surface and one or more walls extending away from the rear surface at approximately right angles to the rear surface, wherein the one or more walls form a shell cavity with a shell cavity opening on the opposite side of the shell cavity from the rear surface, a first bus bar, wherein the first bus bar extends through the rear surface and into the shell cavity. The electrical connection system also includes a plug including: a plug cavity defined by a base and by one or more walls extending away from the base at approximately right angles to the base, wherein the one or more walls form a plug cavity opening on the opposite side of the plug cavity from the base; a second bus bar, wherein the second bus bar extends through the base and into the plug cavity, a first electrical contact and a second electrical contact, wherein the first electrical contact and the second electrical contact are arranged within the plug cavity. The first electrical contact is arranged to make a mechanical and electrical connection to a first surface of the second bus bar, and the second electrical contact is arranged to make a mechanical and electrical connection to a second surface of the second bus bar, wherein the second surface is opposite the first surface. The receptacle is configured to mate with the plug and when the receptacle and the plug are in a mated position, the electrical contacts are arranged to form an electrical connection between the first bus bar and the second bus bar.

Example 7. The system of example 6, wherein the plug further comprises:

a tensioning device, arranged: within the plug cavity; with a long axis of the tensioning device parallel to a long axis of the first electrical contact and the second electrical contact; such that the tensioning device applies a force to the first electrical contact perpendicular to the first surface of the bus bar, wherein the force presses the first electrical contact toward the bus bar.

Example 8. The system of any combination of examples 6-7, wherein wherein the tensioning device is a first tensioning device, the electrical connection device further comprising a second tensioning device arranged: within the plug cavity; with a long axis of the second tensioning device parallel to a long axis of the first electrical contact and the second electrical contact; such that the tensioning device applies a force to the second electrical contact perpendicular to the second surface of the bus bar, wherein the force from the second tensioning device presses the second electrical contact toward the bus bar.

Example 9. The system of any combination of examples 6-8, wherein the first tensioning device comprises one or more springs configured to apply the force to the first electrical contact, and wherein the second tensioning device comprises one or more springs configured to apply the force to the second electrical contact.

Example 10. The system of any combination of examples 6-9, wherein when the receptacle and the plug are in an unmated position, the springs are configured to push the first tensioning device and the second tensioning device to angle away from the second bus bar, thereby: reducing the compressive force between the first electrical contact and the second bus bar; and reducing the compressive force between the second electrical contact and the second bus bar, wherein the second angle is in an opposite direction from the second bus bar in relation to the first angle; wherein the reduced compressive force allows the first electrical contact and the second electrical contact to a position to slide onto the first bus bar during mating.

Example 11. The system of any combination of examples 6-10, wherein the one or more walls of the shell cowling define an approximately uniform dimension for the shell cavity extending from the rear surface to the plug cavity opening, and wherein the one or more walls of the plug cavity define an approximately uniform dimension for the plug cavity extending from the base to the plug cavity opening.

Example 12. The system of any combination of examples 6-11, wherein when the receptacle and the plug are in the mated position: the shell cowling surrounds the first electrical contact and the second electrical contact; the plug cavity surrounds the shell cowling.

Example 13. The system of any combination of examples 6-12, wherein wherein the plug further comprises a gasket arranged at the base of the plug cavity and along the one or more walls that form the plug cavity, wherein the shell cowling further comprises a sealing face arranged at the opening along the one or more walls that define the shell cavity, and wherein the sealing face is configured to compress the gasket when in the mated position, thereby enclosing the first contact, the second contact, the first bus bar and the second bus bar.

Example 14. The system of any combination of examples 6-13, wherein the plug further comprises: a first tensioning device arranged to apply a first force to the first electrical contact; a second tensioning device arranged to apply a second force to the second electrical contact, wherein the second force is in the opposite direction to the first force; the receptacle further comprises a first friction pad disposed along a first wall of the one or more walls of the shell cavity and a second friction pad disposed along a second wall of the one or more walls of the shell cavity, wherein the first wall is approximately opposite to the second wall; wherein when in the mated position:

the first friction pad applies the first force to the first electrical contact through the first tensioning device, and the second friction pad applies the second force to the second electrical contact through the second tensioning device.

Example 15. The system of any combination of examples 6-14, wherein when moving between an unmated position and the mated position, the first electrical contact slides along a first portion of the first bus bar, thereby providing self-cleaning between the first portion of the first bus bar and the first electrical contact.

Example 16. The system of any combination of examples 6-15, wherein the plug is configured to move between an unmated position and the mated position in a blind mating configuration.

Example 17. A method comprising: forcing, by a first spring of a plug, a first tensioning device in a first direction; forcing, by a second spring of the plug, a second tensioning device in a second direction. The first direction is a reciprocal of the second direction. Also, sliding the first tensioning device along a first friction pad, wherein the first tensioning device is positioned within a plug cavity of the plug and the first friction pad is positioned within a shell cavity of the receptacle, and sliding the second tensioning device along a second friction pad, wherein the second tensioning device is positioned within the plug cavity of the plug and the second friction pad is positioned within the shell cavity of the receptacle. In response to sliding the first tensioning device along the first friction pad, applying by the first friction pad, a first force to the first tensioning device, wherein the first force is in the second direction, and applying, by the first spring, the first force to a first electrical contact. In response to applying the first force to the first electrical contact, sliding the first electrical contact along a first bus bar, wherein the first electrical contact is positioned within the plug cavity and the first bus bar is positioned within the shell cavity. In response to sliding the first electrical contact along the first bus bar, establishing, by the first electrical contact, an electrical connection between the first bus bar and a second bus bar, wherein the second bus bar is positioned within the plug cavity.

Example 18. The method of example 17, further comprising: applying by the second friction pad, a second force to the second tensioning device, wherein the second force is in the first direction; applying, by the second spring, the second force to a second electrical contact; in response to applying the second force to the second electrical contact, sliding the second electrical contact along a first surface of the first bus bar, wherein: the second electrical contact is positioned within the plug cavity; the first electrical contact slides along a second surface of the first bus bar, wherein the second surface is on an opposite side of the bus bar from the first surface; and the electrical connection is a first electrical connection; and in response to sliding the second electrical contact along the first bus bar, forming, by the second electrical contact, a second electrical connection between the first bus bar and the second bus bar.

Example 19. The method of any combination of examples 17-18, further comprising, in response to the moving, forming an environmental seal between the plug cavity and the shell cavity, wherein the shell cavity comprises a sealing face and the plug cavity comprises a gasket.

Example 20. The method of any combination of examples 17-19, wherein the plug and the receptacle are configured to move from the unmated position to the mated position in a blind-mating configuration.

Various examples of the disclosure have been described. These and other examples are within the scope of the following claims.

What is claimed is:

1. An electrical connection device, the device comprising:

a plug cavity defined by a base and by one or more walls extending away from the base at approximately right angles to the base, wherein the one or more walls form an opening on the opposite side of the plug cavity from the base;

a bus bar, wherein the bus bar extends through the base and into the plug cavity, a first electrical contact and a second electrical contact, wherein the first electrical contact and the second electrical contact are arranged within the plug cavity, wherein the first electrical contact is arranged to make a mechanical and electrical connection to a first surface of the bus bar, and wherein the second electrical contact is arranged to make a mechanical and electrical connection to a second surface of the bus bar, wherein the second surface is opposite the first surface;

a tensioning device, arranged:

within the plug cavity;

with a long axis of the tensioning device parallel to a long axis of the first electrical contact and the second electrical contact;

such that the tensioning device applies a force to the first electrical contact perpendicular to the first surface of the bus bar, wherein the force presses the first electrical contact toward the bus bar.

2. The device of claim 1, wherein the tensioning device comprises one or more springs configured to apply the force to the first electrical contact.

3. The device of claim 1, wherein the tensioning device is a first tensioning device, the electrical connection device further comprising a second tensioning device arranged:

within the plug cavity;

with a long axis of the second tensioning device parallel to a long axis of the first electrical contact and the second electrical contact;

such that the tensioning device applies a force to the second electrical contact perpendicular to the second surface of the bus bar, wherein the force from the second tensioning device presses the second electrical contact toward the bus bar.

4. The device of claim 1, wherein the one or more walls define an approximately uniform dimension for the plug cavity extending from the base to the opening.

5. The device of claim 1, further comprising a gasket disposed along the base of the plug cavity.

6. An electrical connection system, the system comprising:

a receptacle including:

a shell cowling, wherein the shell cowling comprises a rear surface and one or more walls extending away from the rear surface at approximately right angles to the rear surface, wherein the one or more walls form a shell cavity with a shell cavity opening on the opposite side of the shell cavity from the rear surface;

a first bus bar, wherein the first bus bar extends through the rear surface and into the shell cavity;

a plug including:

a plug cavity defined by a base and by one or more walls extending away from the base at approximately right angles to the base, wherein the one or more walls form a plug cavity opening on the opposite side of the plug cavity from the base;

a second bus bar, wherein the second bus bar extends through the base and into the plug cavity, a first electrical contact and a second electrical contact, wherein the first electrical contact and the second electrical contact are arranged within the plug cavity, wherein the first electrical contact is arranged to make a mechanical and electrical connection to a first surface of the second bus bar, and wherein the second electrical contact is arranged to make a mechanical and electrical connection to a second surface of the second bus bar, wherein the second surface is opposite the first surface, wherein the receptacle is configured to mate with the plug, wherein when the receptacle and the plug are in a mated position, the electrical contacts are arranged to form an electrical connection between the first bus bar and the second bus bar.

7. The system of claim 6, wherein the plug further comprises:

a tensioning device, arranged:

within the plug cavity;

with a long axis of the tensioning device parallel to a long axis of the first electrical contact and the second electrical contact;

such that the tensioning device applies a force to the first electrical contact perpendicular to the first surface of the first bus bar, wherein the force presses the first electrical contact toward the first bus bar.

8. The system of claim 7, wherein the tensioning device is a first tensioning device, the electrical connection device further comprising a second tensioning device arranged:

within the plug cavity;

with a long axis of the second tensioning device parallel to a long axis of the first electrical contact and the second electrical contact;

such that the tensioning device applies a force to the second electrical contact perpendicular to the second surface of the first bus bar, wherein the force from the second tensioning device presses the second electrical contact toward the first bus bar.

9. The device of claim 8, wherein the first tensioning device includes one or more springs assembled to a compression bar, wherein the one or more springs are configured to apply the force to the first electrical contact, and wherein the second tensioning device includes one or more springs assembled to a compression bar, wherein the one or more springs are configured to apply the force to the second electrical contact.

10. The system of claim 9, wherein when the receptacle and the plug are in an unmated position, the springs are configured to push the first tensioning device and the second tensioning device away from the second bus bar, thereby:

reducing the compressive force between the first electrical contact and the second bus bar; and reducing the compressive force between the second electrical contact and the second bus bar;

wherein the reduced compressive force allows the first electrical contact and the second electrical contact to a position to slide onto the first bus bar during mating.

11. The system of claim 6, wherein the one or more walls of the shell cowling define an approximately uniform dimension for the shell cavity extending from the rear surface to the plug cavity opening, and wherein the one or more walls of the plug cavity define an approximately uniform dimension for the plug cavity extending from the base to the plug cavity opening.

12. The system of claim 6, wherein when the receptacle and the plug are in the mated position:

the shell cowling surrounds the first electrical contact and the second electrical contact;

the plug cavity surrounds the shell cowling.

13. The system of claim 6, wherein the plug further comprises a gasket arranged at the base of the plug cavity and along the one or more walls that form the plug cavity, wherein the shell cowling further comprises a sealing face arranged at the opening along the one or more walls that define the shell cavity, and wherein the sealing face is configured to compress the gasket when in the mated position, thereby enclosing the first contact, the second contact, the first bus bar and the second bus bar.

14. The system of claim 6, wherein:

the plug further comprises:

a first tensioning device arranged to apply a first force to the first electrical contact;

a second tensioning device arranged to apply a second force to the second electrical contact, wherein the second force is in the opposite direction to the first force;

the receptacle further comprises a first friction pad disposed along a first wall of the one or more walls of the shell cavity and a second friction pad disposed along a second wall of the one or more walls of the shell cavity, wherein the first wall is approximately opposite to the second wall;

wherein when in the mated position:

the first friction pad applies the first force to the first electrical contact through the first tensioning device, and the second friction pad applies the second force to the second electrical contact through the second tensioning device.

15. The system of claim 6, wherein when moving between an unmated position and the mated position, the first electrical contact slides along a first portion of the first bus bar, thereby providing self-cleaning between the first portion of the first bus bar and the first electrical contact.

16. The system of claim 6, wherein the plug is configured to move between an unmated position and the mated position in a blind mating configuration.

17. A method comprising:

forcing, by a first spring of a plug, a first tensioning device in a first direction;

forcing, by a second spring of the plug, a second tensioning device in a second direction, wherein the first direction is a reciprocal of the second direction;

sliding the first tensioning device along a first friction pad, wherein the first tensioning device is positioned within a plug cavity of the plug and the first friction pad is positioned within a shell cavity of the receptacle; and sliding the second tensioning device along a second friction pad, wherein the second tensioning device is positioned within the plug cavity of the plug and the second friction pad is positioned within the shell cavity of the receptacle;

in response to sliding the first tensioning device along the first friction pad, applying by the first friction pad, a first force to the first tensioning device, wherein the first force is in the second direction;

applying, by the first spring, the first force to a first electrical contact;

in response to applying the first force to the first electrical contact, sliding the first electrical contact along a first bus bar, wherein the first electrical contact is positioned within the plug cavity and the first bus bar is positioned within the shell cavity;

in response to sliding the first electrical contact along the first bus bar, establishing, by the first electrical contact, an electrical connection between the first bus bar and a second bus bar, wherein the second bus bar is positioned within the plug cavity.

18. The method of claim 17, further comprising:

applying by the second friction pad, a second force to the second tensioning device, wherein the second force is in the first direction;

applying, by the second spring, the second force to a second electrical contact;

in response to applying the second force to the second electrical contact, sliding the second electrical contact along a first surface of the first bus bar, wherein:

the second electrical contact is positioned within the plug cavity;

the first electrical contact slides along a second surface of the first bus bar, wherein the second surface is on an opposite side of the first bus bar from the first surface; and the electrical connection is a first electrical connection; and in response to sliding the second electrical contact along the first bus bar, forming, by the second electrical contact, a second electrical connection between the first bus bar and the second bus bar.

19. The method of claim 17, further comprising, in response to the moving, forming an environmental seal between the plug cavity and the shell cavity, wherein the shell cavity comprises a sealing face and the plug cavity comprises a gasket.

20. The method of claim 17, wherein the plug and the receptacle are configured to move from the unmated position to the mated position in a blind-mating configuration.

* * * * *